United States Patent [19]

Gunther, Jr.

[11] Patent Number: 4,694,631

[45] Date of Patent: Sep. 22, 1987

[54] MECHANISM FOR FOLDING AN ENVELOPE AROUND AN INSERT

[75] Inventor: William H. Gunther, Jr., Mystic, Conn.

[73] Assignee: Gunther International, Ltd., Mystic, Conn.

[21] Appl. No.: 874,043

[22] Filed: Jul. 31, 1986

Related U.S. Application Data

[63] Continuation of Ser. No. 747,704, Jun. 24, 1985, abandoned, which is a continuation of Ser. No. 423,665, Sep. 27, 1982, abandoned.

[51] Int. Cl.[4] ..... B65B 11/48; B65B 57/00

[52] U.S. Cl. ..... 53/55; 53/206; 53/209

[58] Field of Search ..... 53/206, 209, 460, 534, 53/55; 209/900, 584

[56] References Cited

U.S. PATENT DOCUMENTS

| | | | |
|---|---|---|---|
| 2,932,929 | 4/1960 | Fahrenbach | 53/209 |
| 3,051,309 | 8/1962 | Leathers | 209/900 |
| 3,059,391 | 10/1962 | Volks | 53/206 |
| 3,162,434 | 12/1964 | Hepp | 53/206 |
| 3,457,696 | 7/1969 | Berkley | 53/206 |
| 3,511,368 | 5/1970 | Kajitani | 209/900 |
| 3,601,952 | 8/1971 | Cato | 53/534 |
| 3,983,679 | 10/1976 | Zemke | 53/460 |
| 4,071,997 | 2/1978 | Gunther | 53/460 |
| 4,299,073 | 11/1981 | Golicz | 53/206 |
| 4,343,129 | 8/1982 | Gunther | 53/206 |

*Primary Examiner*—John Sipos

*Attorney, Agent, or Firm*—Stoll, Wilkie, Previto & Hoffman

[57] ABSTRACT

A mechanism for automatically feeding individual pre-cut sheets and stuff a personalized letter or some other pre-cut inset into a personalized envelope. The mechanism has means to permit additional inserts to be automatically added to the envelope and to automatically seal the contents within the envelope. The mechanism will also combine pre-cut inserts and envelopes fed from different sources and form them into a completed mailing envelope.

19 Claims, 1 Drawing Figure

MECHANISM FOR FOLDING AN ENVELOPE AROUND AN INSERT

Figure 1:
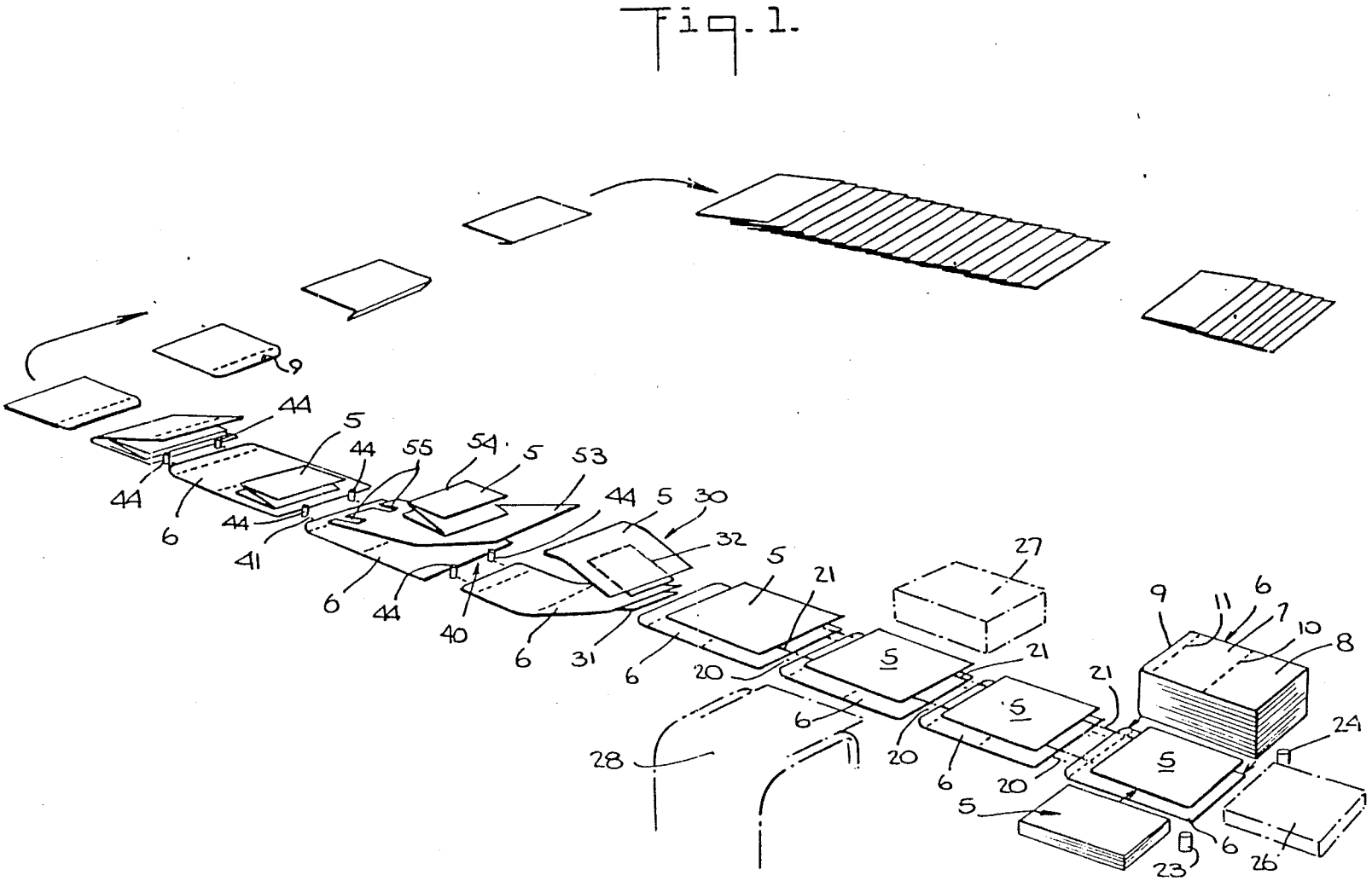

This application is a continuation of pending U.S. application Ser. No. 747,704, filed June 24, 1985, now abandoned, which, in turn, is a continuation of Ser. No. 423,665, filed Sept. 27, 1982, now abandoned.

CROSS-REFERENCE

This application is an improvement over U.S. Pat. Nos. 4,343,129; 4,312,109 and 4,071,997 and the disclosures in said patents are incorporated herein by reference.

DESCRIPTION

The present invention is directed to an improved mechanism for making and folding an envelope and more particularly to a mechanism for folding an envelope around a letter or some other insert.

In various promotions, such as solicitations for subscribers, funds, etc., it is desirable for the envelope and the letter, or other similar insert or message enclosed within the envelope, to be personalized. Even if the personalized insert and envelope are both automatically printed by a computer, it is an expensive and a time consuming operation to stuff the personalized letter or other insert into the corresponding personalized envelope and to seal it. In addition, it is sometimes desirable to add additional inserts to be sent with the letter.

There exists machinery to produce a letter from a continuous web that is personalized to an individual along with an envelope that is to be used for that same individual. The letter and envelope either follow one another or are adjacent to each other on a side-by-side relationship. That machine was designed to take into account that printers used continuous webs in conjunction with the computers of that time.

However, there now exists high speed laser computer printers which work from individual pre-cut sheets and not from continuous webs. Present machines do not provide for automatic feeding of pre-cut inserts and envelopes for automatic wrapping of envelopes around the inserts and for automatically adding additional inserts to the envelopes.

The present invention overcomes these difficulties and has for one of its objects the provision of an improved mechanism which will automatically feed individual pre-cut sheets and stuff a personalized letter or some other pre-cut insert, such as a return envelope or the like, into a personalized envelope, and which will permit additional inserts to be automatically added to the envelope and which will automatically seal the contents within the envelopes.

Another object of the present invention is the provision of an improved mechanism for combining pre-cut inserts and envelopes fed from different sources and form them into a completed mailing enclosure.

Other and further objects of the invention will be obvious upon an understanding of the illustrative embodiment about to be described, or will be indicated in the appended claims, and various advantages not referred to herein will occur to one skilled in the art upon employment of the invention in practice.

The machine of the present invention is capable of feeding from two stacks of sheets—one being a letter or other message to an individual and the other being a blank used for the envelope which has also been computerized and addressed to that same individual. The machine may include an optical reading recognition mechanism, either by Optical Mark Reading (OMR) or Bar Code Reading (BCR) or an Optical Character Recognition (OCR) where an individual's name or Arabic printed number is read, decoded and identified to coincide with the same name or number on a corresponding document.

In existing printing machines, the forms are printed and delivered upside down so that the first form is face down in the delivery mechanism. Thus, if the hopper held one thousand sheets, sheet No. 1 would be on the bottom and sheet No. 1,000 would be on the top. When this stack of papers were processed, the next stack would have a sheet on the bottom with No. 1,001 and the last sheet on the top would be No. 2,000. Since existing folding or sealing machines must take sheets into its system face down, if such stacks were used as they were produced by the printing machine, the first stack would be processed with sheet No. 1,000 the first to be produced and sheet No. 1 the last to be produced. The next stack then would start with sheet No. 1,001 which would follow sheet No. 1 of the previous stack thereby making the entire system out of zip code sequence.

Although this could be overcome by completing a total run of 1,000,000 forms before the first letter would be run through pre-cut folding and sealing machines and then run them in reverse order, starting with 1,000,000 back to 1 so that they could then still stay in zip code order, the storage of the various stacks of paper would be inconvenient and could cause some major problems in that the two machines could not be run simultaneously which is one of the requisites of the competitive business using direct mail production in order to get things done as they are being produced.

The present invention overcomes these drawbacks and provides a machine having two bottom feeding devices or hoppers which would process pre-cut letters and envelopes exactly as they are produced from a printer and feed them from the bottom so that the hoppers can continue to be loaded from the top. As each sheet is fed out of the hopper or feeding device, it is read by a reading mechanism to verify that the letter insert did in fact match the name and address on the envelope. Additional information could be read from the letter part indicating that there would be more than one sheet to the letter.

There are also provided means as to whether additional feeders should be activated which would add single or multiple personalized or unpersonalized sheets during the movement of the original letter and envelope on the conveyor system. The original letter would also contain information whether or not additional inserts, placed on the machine should or should not be activated to add advertising or other type documents to the package. Finally, the same reading mechanism also disseminates zip code sorting and weight sorting for each individual letter as it was being produced.

The machine is a two level conveyor system capable of moving the envelope at one level and the letter insert at a higher level with feeders on opposite sides feeding the documents sideways into the conveyor so that they would move at a right angle directly into the machine. Space would be left for two or more additional feeders on each side of the conveyor in the event that the customer wished to have the ability to add additional sheets to the letter which are called for in many instances.

The same mechanism could also be used to feed from continuous form multiple pages being added where the other side would be run from either sheet produced envelopes or continuous form envelopes, but only one envelope to each customer. This ability is not available with the existing machines.

A preferred embodiment of the invention has been chosen for purposes of illustration and description and is shown in the accompanying drawings forming a part of the specification, wherein:

FIG. 1 is a schematic diagrammatic view of the present invention.

Referring more particularly to the drawing, a stack of inserts 5 is provided as well as a stack of envelopes 6. Each stack are provided in hoppers (not shown) face down. Each letter or insert assembly 5 may have a message and a personalized address thereon and may also have other codes thereon. Each envelope assembly 6 has a front panel 7 which has a personalized address, which corresponds to the personalized address on the letter assembly 5 it is to be combined with, as well as a return address. Each envelope 6 has a rear panel 8 attached to a front panel 7 by a fold line 10 and flap 9 attached by fold line 11 to the front panel 7.

The stacks of inserts 5 and envelopes 6 are preferably on either side of a pair of superimposed conveyor means 20–21. The stacks of letters 5 and envelopes 6 are fed from the bottom by any conventional feeding means, such as vacuum means, so that the insert 5 is deposited on the upper conveyor means 21 and the envelope is on the lower conveyor 20. As has been explained above, the numbering of the inserts in the stacks are in inverse order so that additional inserts may be placed on top of it. The letters 5 and inserts 6 have code indicia thereon and the machine is provided with reading means 23 and 24, beneath each stack of letters 5 and envelopes 6, respectively. These reading means are designed to read codes or other indicia on the letters 5 and envelopes 6 to insure that the proper envelope 6 is matched with the proper letter 5. The reading devices 23 and 24 may also read other indicia on letters 5 or envelopes 6 which directs the machine to have additional inserts deposited on the envelope.

The envelope 6 and the letter 5 move along by conveyors 21–20 until they reach the diverting mechanism 30. Preferably, the movement of conveyors 20–B21 is staggered so that both feed mechanisms can feed from the bottom of the stacks of letters 5 and envelopes 6 simultaneously.

If desired, additional feed mechanisms may be provided either behind conveyor means 20–21 or downstream thereof to feed additional pre-cut inserts to the conveyor. Furthermore, it is also possible to use a continuous web feed means 28 which will supply other inserts which have not been pre-cut but which are cut before they are fed to the conveyor system 20–21.

Immediately in front of the conveyor means 20–21 is the diverting assembly 30 comprising downward ramp mechanism 31 adapted to deflect the envelope assembly 6 downwardly onto conveyor means 40 and upward ramp means 32 adapted to move the insert assembly 5 upwardly for insertion in a folding assembly (not shown).

The conveyor means 40 comprise a continuously moving conveyor 41 which may be driven by a wheel and chain assembly (not shown). The conveyor 41 has a plurality of transversely located upwardly extending longitudinally spaced drive pins 44. The drive pins 44 are located on each side of the center line of the conveyor 41. When the envelope assemblies 6 are deposited onto the conveyor 41, the pins 44 strike the rear edge of each envelope assembly 6 to move it along with the conveyor 41. The pins 44 are adapted not only to strike and move the envelope assembly 6 but also to cause the letter assemblies 5 to be deposited onto the envelope assembly 6 and to move the envelope assembly 6 and the letter assembly 5 along together.

The folding mechanism which folds the letter assembly 5 before it is deposited onto the envelope assembly 6 may be any well known mechanism, which will fold the letter assembly 5 in two or more folds, for example, a mechanism similar to the one shown in U.S. Pat. No. 1,879,990. This will fold the letter assembly 5 in two or more folds depending on the particular type of folding desired. The folding mechanism is a standard folding mechanism and, hence, will not be described in greater detail.

After the letter assembly 5 is folded, it is moved to an inclined chute 53 which overlies the conveyor 41, and terminates in a horizontal toe 54. The letter assembly slides down the chute 53 until it rests on the toe 54. Rollers (not shown) may be used to push the letters downwardly on the slide 53, if desired. The toe 54 is positioned in close adjacency over the conveyor 41. The chute 53 has longitudinal slits 55 therein to permit the pins 44 of the conveyor 41 to move therethrough. Guide rails (not shown) may also be provided to prevent the letter assembly 5 from angling when sliding down chute 53.

With the letter assembly 5 resting on toe 54, the pins 44 which are moving the envelope assembly 6 forward, move through the slits 55 and strike the rear edge of the folded letter assembly 5 so as to move it off toe 54 and deposit it on their corresponding personalized envelope assembly 6. Since the letter assembly 5 is moving at about the same speed as the envelope assembly 6, chute 53 allows letters 5 to move down to toe 54 at least as quickly as it takes the envelopes to be positioned below toe 54 so that each personalized letter assembly 5 will be deposited on its respective personalized envelope assembly 6.

The envelope assembly 6 with letter assembly 5 thereon may then be moved by pins 44 beneath an additional insert depositing assembly (not shown) where additional inserts may be deposited, if desired.

The combination may then be moved by pins 44 beneath an adhesive applicator (not shown) which applies adhesive to the envelope assembly 6. The adhesive applicator may be any conventional type of applicator, such as a sprayer, a roller, or a spotter. However, a pre-gummed envelope may also be used, if desired. The combination is then moved to an envelope wrapping assembly (not shown) which folds the envelope.

The folded and edge sealed envelope assembly 6 is then moved onto a second conveyor (not shown) which is at an angle (preferably at a right angle) to the first conveyor 41. The second conveyor moves the envelope past a flap folding mechanism (not shown) which folds the flap 9 as each envelope moves past it. An adhesive is applied to flap 9 by a suitable applicator as the envelope assembly 6 moves past it. The envelope assembly 6 is then moved past a suitable pressure roller which seals flap 9 and is then moved off the conveyor.

The various components which are shown and described herein have been illustrated schematically for ease in description. The actual components used are well-known mechanisms and may be the ones which are described and shown in U.S. Pat Nos. 4,299,073; 4,343,129 and 4,071,997 although it will be understood that other components may be used in connection with the invention, if desired.

It will thus be seen that the present invention provides an improved mechanism which will automatically feed individual pre-cut sheets and stuff a personalized letter or some other pre-cut insert into a personalized envelope, which will permit additional inserts to be automatically added to the envelope, which will automatically seal the contents within the envelopes and which will combine pre-cut inserts and envelopes fed from different sources and form them into a completed mailing envelope.

Although the application has been described with respect to a personalized envelope assembly and a personalized insert assembly, it will be understood that the invention is equally applicable to unpersonalized insert assemblies as well as unpersonalized envelope assemblies. Likewise, the application may be used with a personalized envelope assembly and an unpersonalized insert assembly as well as a personalized insert assembly and an unpersonalized envelope assembly. In fact, the invention is even applicable to the use of a window envelope assembly where the address of the insert assembly would show through. In addition, the invention is adapted to be used with a multi-sheet personalized insert assembly which would be fed into either a personalized or unpersonalized envelope assembly.

As stated above, the reading units determine the number of inserts to be used with a particular envelope assembly. For convenience, the data on the insert assemblies and the letter assemblies which is readable by the reading means, would preferably be located on an edge of the two assemblies which could thereafter be cutoff or otherwise removed before the two assemblies are assembled together.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A mechanism for forming an envelope comprising a stack of pre-cut single predetermined individual envelope assemblies and a stack of pre-cut single predetermined individual letter insert assemblies, first means for moving each individual envelope assembly along a first path, second means for moving each individual letter insert assembly along a second path, said first and second moving means comprising a pair of conveyor mechanisms superimposed over and in spaced relationship to each other, each conveyor mechanism being adapted to receive an assembly, each of said assemblies being individually fed to their respective conveyor mechanism from stacks of assemblies, code data on said letter insert assembly and said envelope assembly, reading means adjacent the stacks for sensing said code data to determine whether an insert assembly matches an envelope assembly before said assemblies are fed to their respective conveyor mechanisms and before the assemblies are fed from the stacks, means for comparing the code data sensed by the reading means to determine whether a predetermined letter insert assembly is matched with a predetermined envelope assembly whereby feeding from said stacks is interrupted if the code data on the predetermined letter insert assembly does not match with a predetermined envelope assembly, third and fourth means in line with said first and second moving means for receiving said assemblies from said first and second moving means and for causing said assemblies to move along superimposed third and fourth paths, said third means includes means for folding each letter insert assembly and for positioning each predetermined letter insert assembly in superimposed relationship to each predetermined envelope assembly, said fourth means includes means for causing said folded letter insert assembly to be deposited on top of said moving envelope assembly means for folding said envelope assembly around said letter insert assembly and means for sealing the edges of said envelope assembly.

2. A mechanism as claimed in claim 1 wherein said assemblies are fed to their respective conveyors from stacks of assemblies.

3. A mechanism as claimed in claim 2 wherein said stacks of assemblies are fed from the bottom to said conveyors.

4. A mechanism as claimed in claim 3 wherein said means to read data on said assemblies as they are fed to said conveyors are located beneath each of said stacks.

5. A mechanism as claimed in claim 4 wherein said letter insert assembly moving means comprises a slide chute overlying the conveyor means down which the letter insert assembly slides, said slide chute having a lower toe overlying the conveyor means.

6. A mechanism as claimed in claim 5 wherein additional insert supplying means are provided adjacent said first conveyor means.

7. A mechanism as claimed in claim 6 wherein said envelope assembly moving means comprises conveyor means having upstanding pins adapted to strike the envelope assembly.

8. A mechanism as claimed in claim 7 wherein means are provided for applying adhesive to the edges of the envelope assembly.

9. A mechanism as claimed in claim 8 wherein pressure applying means are provided to seal the edges of the folded envelope assembly.

10. A mechanism as claimed in claim 9 wherein means are provided for transferring said folded envelope assembly to a flap folding means.

11. A mechanism as claimed in claim 10 wherein said flap folding means comprises second conveyor means moving at an angle to said first conveyor means.

12. A mechanism as claimed in claim 11 wherein adhesive is applied to the envelope flap, means are provided to turn the flap and a pressure means are provided to seal the flap.

13. A mechanism as claimed in claim 12 wherein said envelope assembly and said letter insert assembly are on a continuous web and wherein outer means are provided in advance to said deflecting means to separate the letter insert assembly from the envelope assembly.

14. A mechanism as claimed in claim 13 wherein a cutter is provided to cut the web along the center, to separate the letter assembly from the envelope assembly.

15. A mechanism as claimed in claim 14 wherein guides are provided on the chute to prevent the letter insert assembly from angling.

16. A mechanism as claimed in claim 15 wherein an adhesive applicator applies adhesive to the edges of the envelope assembly to seal them.

17. A mechanism as claimed in claim 4 wherein insert assemblies are personalized.

18. A mechanism as claimed in claim 4 wherein at least one of said assemblies is personalized.

19. A mechanism as claimed in claim 18 wherein both of said assemblies are personalized.

* * * * *